US006435145B1

(12) United States Patent
Said

(10) Patent No.: US 6,435,145 B1
(45) Date of Patent: Aug. 20, 2002

(54) INTERNAL COMBUSTION ENGINE WITH DRIVE SHAFT PROPELLED BY SLIDING MOTION

(76) Inventor: Moises Antonio Said, Urbanizacion Residencial 'Abril', Autopista La Plata KM 31, Hudson, (1884) Berazategui, Province of Buenos Aires (AR)

( * ) Notice: Subject to any disclaimer, the term of this patent is extended or adjusted under 35 U.S.C. 154(b) by 0 days.

(21) Appl. No.: 09/709,641

(22) Filed: Nov. 13, 2000

(51) Int. Cl.[7] ..... F02B 75/04
(52) U.S. Cl. ..... 123/56.1
(58) Field of Search ..... 123/56.1–56.8

(56) References Cited

U.S. PATENT DOCUMENTS

| | | | | | |
|---|---|---|---|---|---|
| 1,177,609 | A | | 4/1916 | Edwards | |
| 1,181,463 | A | | 5/1916 | Fontaine | |
| 1,545,925 | A | | 7/1925 | Powell | |
| 1,628,100 | A | | 5/1927 | Bacon | |
| 1,799,772 | A | | 4/1931 | Wormley | |
| 2,274,097 | A | | 2/1942 | Sheerer | 123/58 |
| 2,353,313 | A | | 7/1944 | Lane | 74/569 |
| 2,856,781 | A | | 10/1958 | Forbes | 74/56 |
| 3,598,094 | A | | 8/1971 | Odawara | 123/58 R |
| 3,745,887 | A | | 7/1973 | Striegl | 92/146 |
| 3,895,614 | A | | 7/1975 | Bailey | 123/67 |
| 3,938,397 | A | * | 2/1976 | Rasmussen | 123/58 BA |
| 3,939,717 | A | * | 2/1976 | Teisen | 123/58 BA |
| 3,943,895 | A | | 3/1976 | Howell | 123/58 AA |
| 4,152,944 | A | * | 5/1979 | Kemper | 123/58 AA |
| 4,366,784 | A | | 1/1983 | Paul | 123/45 A |
| 4,515,113 | A | * | 5/1985 | Delorean | 123/48 C |
| 4,565,165 | A | | 1/1986 | Papanicolaou | 123/51 BA |
| 4,622,927 | A | * | 11/1986 | Wenker | 123/58 B |
| 5,269,193 | A | * | 12/1993 | Rabinow | 123/58 BB |
| 5,638,778 | A | * | 6/1997 | James | 123/56.6 |
| 5,749,337 | A | | 5/1998 | Palatov | 123/56.2 |
| 5,890,462 | A | | 4/1999 | Bassett | 123/56.2 |
| 5,992,357 | A | | 11/1999 | Tasi | 123/56.2 |

* cited by examiner

*Primary Examiner*—Marguerite McMahon
(74) *Attorney, Agent, or Firm*—Crowell & Moring LLP

(57) ABSTRACT

An internal combustion having engine pistons which transmit their power by way of their rods contacting on the polished surface of a connecting member in the form of a guide track mounted on the drive shaft in which the geometrical axis of the drive shaft intersects the principal plane of said connecting piece forming a certain angle, thus avoiding the need for a crankshaft and obtaining greatly improved mechanical output efficiency, as well as lower construction cost compared with presently known engines.

10 Claims, 8 Drawing Sheets

FIG. 15
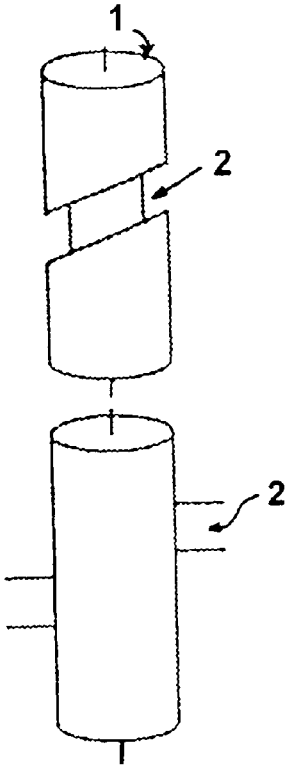
FIG. 16
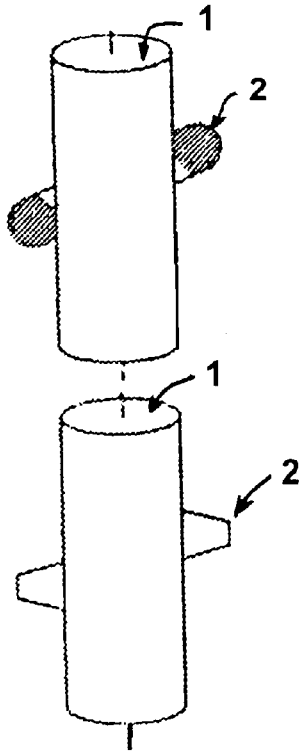
FIG. 17
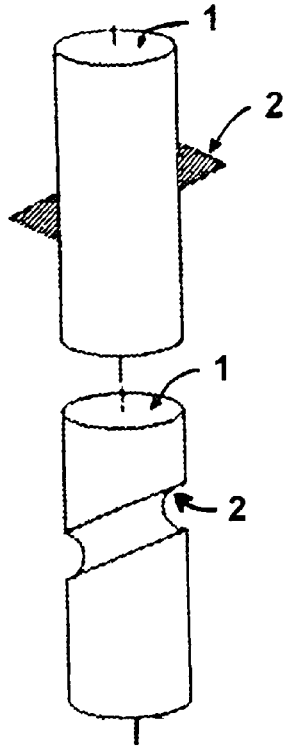
FIG. 18
FIG. 19
FIG. 20
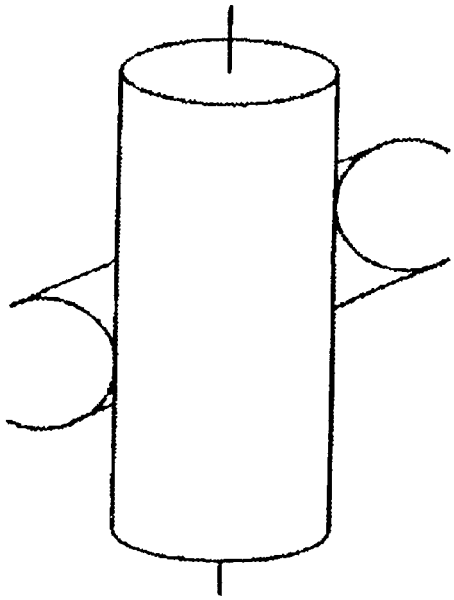
FIG. 21

INTERNAL COMBUSTION ENGINE WITH DRIVE SHAFT PROPELLED BY SLIDING MOTION

TECHNICAL FIELD

The present invention refers to an internal combustion engine with a sliding drive shaft, which can work both as a four or two-stroke Otto cycle engine, or as a two- or four-stroke Diesel engine, depending on the way in which it is built, being highly efficient in all versions.

Although in the industry a large variety of internal combustion engines pursuing the same purpose are already known, many of them working at even higher levels of efficiency, these nevertheless require parts which are somewhat complex to build, such as crankshafts, bearings, connecting rods and camshafts, with geometric forms that lead to, amongst other things, a considerable increase in the price of the end-product, as well as in its subsequent maintenance.

It is for this reason that in the present invention an easily constructed mechanism has been developed, the main features of which can be summarized as follows:

a) The mechanism does not have a crankshaft (a mechanism which requires great precision in its construction, complex machining and careful dynamic balancing).

b) The stroke of the pistons is not limited by the size of the crankshaft.

c) A greater number of cylinders are allowed for, resulting in more power in the same space, thus achieving a better power/weight ratio as well as a smoother-running engine.

d) It does not require connecting-rods, nor main nor connecting-rod bearings.

e) Construction costs are lower than those for equivalent engines so far designed.

f) The maintenance required is simpler.

g) Fuel consumption can be reduced as the piston stroke can be longer than that of conventional internal combustion engines.

h) Its construction requires only a few simple elements that are easily obtainable both industrially and commercially.

i) Several inlet and exhaust valves can be driven by one simple circular cam shaft.

j) The oil pan can also be cylindrical, thus simplifying engine lubrication and cooling.

k) The lubrication of the element which connects each piston with the drive shaft can be made easier by the action of the centrifugal forces developed within it as it rotates.

l) The camshaft, which can be mounted on concentric shafts, permits variable distribution regulation of the inlet and exhaust valves, improving the intake into the cylinders and providing strong coupling even at low and medium engine speeds.

m) The piston stroke, if so desired, can be variable, so that in special cases the compression ratio of the engine can be changed with the engine running.

RELATED PRIOR ART

U.S. Pat. No. 1,177,609 describes a means for converting reciprocating motion into rotary motion. The document describes a cylinder which may be part of a gas or steam engine or any other prime motor, in which a piston 2 is mounted to reciprocate and actuate a piston rod extending through the cylinder. Although the embodiment shown on FIG. 2 seems to anticipate the present invention, this is not really so because this early engine development shows strong design handicaps. For example, the pins 22 in FIG. 2 are received by the groove 21 of the cam following a single contact line and not a particular surface. The fact that all the piston's force is applied on thin grooves creates a very high pressure stress and premature material wear-out on the engagement parts. From a production point of view, groove 21 is difficult to create and needs special numeric control tools. In FIG. 1, the groove 10 is also difficult to create because it should be in all its track perpendicular to the rotation axis of the fly-wheel or band pulley 13 and will also need special and sophisticated tooling. A major difference among the mentioned document and the present invention is the fact that in the former the engagements zones are engraved into the movable parts instead of being surface outwards projecting members as in the latter. The cited document also fails to describe a simplified solution for a camshaft as is described in the present invention. Further, in FIG. 1 pin 5, roller 6 and pin 22, all keep a fixed 90° angle respect of the driving axis but, due to the movement of the cam groove 10 and the cam 21, when these rotate the engagement angle changes and then the whole mechanism would get jammed. Therefore it seems that the mechanism will never be able to work.

U.S. Pat. No. 1,181,463 describes an engine in which the power of a reciprocal piston is to be transmitted directly to a shaft extending parallel with the piston rod and without the use of intermediate cranks. FIG. 2 shows that the drum L is provided with an exterior circumferential cam M formed by a pair of radial projecting ribs, the adjacent faces of which are oppositely inclined or beveled. Each piston rod cross head F is provided with a pin of anti-friction contact rolls I, J and the ribs of the cam M is such that the roll J will continuously contact with the surface of the cam adjacent the end A of the frame while the roller I similarly contacts continuously with the cam surface adjacent the frame end A, being the diameter of the roller J less than the width of the cam way or groove in which it moves. As may be clearly seen, the path to which the rollers are constrained to, form a line path and not a surface as in the present invention. The cam groove of FIGS. 1, 2 and 3 of the mentioned patent shows four length portions with a different track shape in each portion, one for each step of the well known four-step explosion motor. Therefore, this track design may not be used in other motors with different number of steps. However, in the present invention the tracks are parallel and straight, and therefore the present invention may be used in a four step, two step or Diesel motor with no changes.

U.S. Pat. No. 1,545,925 describes an internal combustion engine having a cylinder with an air passage surrounding it, a piston slidable within the cylinder, a reciprocating cylinder driven by the piston, means whereby the air may be compressed in the reciprocating cylinder, means whereby the air may be forced around the cylinder for cooling it, means whereby power may be taken from the reciprocating cylinder, wherein these last means include a rotatable cylinder having closed grooves in its surface and pins carried by the reciprocating cylinder which project into the grooves. In the invention of the mentioned patent, power is transmitted by air which pushes piston 20 (see FIG. 1) and also cools the cylinder. In the present invention, however, power is transmitted by mechanical means. The mentioned patent also teaches away from the present invention because the cams 21 and 22 (FIG. 1) and cams 27 and 28 (FIG. 3) show crossing grooves instead of parallel or congruent track surfaces.

U.S. Pat. No. 1,628,100 shows an engine that converts reciprocating movement into rational motion by means of an ondulating track. FIG. 6 shows the cylinders 4 and the pistons 5, either of which may rotate around the center axle or else the cylinders are fixed and the axle rotates. The ondulating track 2 in FIG. 6 follows a different shape compared to the one described in the present invention and does not offer the favorable features of the one described in the present document.

U.S. Pat. No. 1,799,772 describes an engine including a plurality of cylinders arranged in pairs, a pair of pistons for each pair of cylinders, a common piston rod for each pair of pistons, a power shaft, means for operating the shaft from the rods, wherein the means comprise a stator member and a rotor member, each of which have spiral internal grooves, heads on the rods engaging the grooves, and means for giving an expansive fluid impact to each piston at its outward limit of travel for forcing the same inward for operating the power shaft. However, the principle for transforming reciprocating movement into circular motion of the invention described in the mentioned patent is totally different from the way the present invention achieves this conversion.

U.S. Pat. No. 2,274,097 reveals a crankless engine for converting reciprocating movement into rotational motion. Unlike the present invention, the mentioned patent shows in FIG. 6 a rotational track 30 having a groove 29 which follows a zigzag shape with straight portions 38 and bending portions 37 but does not show a plane or particularly shaped surface. The mentioned document also shows in FIG. 4 a plurality of solenoids 39 for speeding up the compression time, one for each cylinder, in order to enhance spark production in the spark plugs 43 for each one of these. This techique is totally different from the one used in the present invention.

U.S. Pat. No. 2,353,313 describes a rotor shaped as a cylinder having a continuous groove in the peripheral face thereof having intersecting runs the side walls of the groove being parallel from the top to bottom to provide straight thrust-receiving walls, a follower including a rotatable pin adapted to project into the groove, that portion of the pin adapted to project into the groove being of constant diameter throughout its length, and guiding ribs of substantially the same vertical extent as the groove engaging portion of the pin disposed on the follower in front of and to the rear of the pin, the combined length of the ribs and pin being greater than the width of the groove to bridge the reaches of the intersection. The grooved track 28 of FIG. 1 is crisscrossed for allowing that each piston transmits its mechanical power through a rotation of the central axis of at least 180°. FIG. 6 shows in detail (ref. 29–32) the particular design of the groove which, unlike the present invention, is not a surface link and therefore may also develop excessive mechanical wear-out.

U.S. Pat. No. 2,856,781 describes an engine for converting reciprocal motion to rotary motion, comprising a cross-head mounted for reciprocating movement, a rotatable shaft, a cam member carried by the shaft for rotation therewith, at least one cam engaging roller carried by the cross-head in driving engagement with the cam member, the cam member being provided with elongated straight roller engaging cam surfaces connected by relatively short arcuate cam surfaces, the rollers having an axis normal to a parallel offset of the axis of the shaft whereby sliding of the roller relative to the cam surfaces during an effective power stroke of the roller is eliminated. However, since the tracks of FIGS. 1 and 2 are 45° out of phase the engine seems to be only applicable to pairs of opposed pistons. The tracks seem to be quite difficult to be grooved into the cam and the power link is done on an engagement line track which causes rapid wear-out of the power transmission parts compared to the present invention.

U.S. Pat. No. 3,598,094 describes a crankless reciprocating mechanism which is provided with a mechanism for converting a reciprocating motion into a rotary motion or viceversa. The mechanism comprises at least one pin firmly fixed to one or more piston so as to be not movable relative thereto and extending radially outwardly thereform, and an endless cam mounted in a fixed part of a rotating part, the pin cam operatively connecting the reciprocating motion of the piston(s) with the rotary motion of the rotating part. FIGS. 17*a*–17*f* show tracks 18 with different shapes but none of these resemble the surface of the present invention. Furthermore, the tracks of the mentioned patent are formed on the inner surface of a piston, which makes it necessary to use special and sophisticated tooling. Pin 8, which transmits power from the piston also contacts a narrow line track and therefore will probably wear out very quickly. The pin 8 contacting the track 18 in FIGS. 2 ,3, 4, 5, 6, 8 and 9 have a fixed 90° respect to the driving axes movement. The same happens with the pin 8 and ball bearing 9 in FIG. 10, the assembly formed by pin 8 and the ball bearing of FIGS. 11, 13,14 and 15 as well as the pin 68 and ball bearing 69 of FIGS. 22 and 23. Since all these elements' position is fixed, the pin seems to jam into the groove when the cam 18 rotates because the latter changes its relative angle and, therefore, it seems this embodiment may never work.

U.S. Pat. No. 3,745,887 describes a power unit and engine where reciprocal motion of piston means are transformed into rotary motion of an output shaft without using cranks or connecting rods, including at least one cylinder piston assembly and an auxiliary aligned rotor cam means connected to a drive shaft means, in operative association with the piston which is guided for reciprocation only, transforming the reciprocal motion of the piston into rotary motion of the drive shaft. FIGS. 7 and 8 show opposite running tracks which guide the pins 88 and 88*a*. The document shows that motion conversion is done along a line and not on a surface, and therefore the involved moving parts will also undergo excessive mechanical wear. Another handicap of the mentioned U.S. patent is that it may only be applied when an even number of opposite pistons are used.

U.S. Pat. No. 3,895,614 describes a two-stroke, four-cycle internal combustion engine with a split piston which reciprocates within a cylinder having a primary and secondary pre-combustion chambers. The lower portion of the piston is split by means of a partition which divides the cylinder into opposed air and combustible charge pumping chambers. One way flow valves are provided to control the flow of air and a combustible charge into respective pumping chambers as the piston moves along its compression stroke. Movement of the piston along its power stroke compresses volumes of air and the charge within the pumping chambers, with these volumes being directed through ports formed in a piston skirt and the cylinder wall into the pre-combustion chambers through oneway flow valves. Exhaust gases are scavenged through exhaust ports in the cylinder wall which are exposed as the piston completes its power stroke, with scavenging being assisted by injection of air directed from the pumping chamber through a one-way flow valve in a mid-portion of the cylinder wall. FIG. 1 shows both cam 36 and pin 34 in an overlapping position which does not allow to see that this machine seems to be unable to work correctly. When piston 81 runs from its top dead center to its bottom dead center the cam 36 will rotate 90°, passing through all its intermediate positions in which the pin 34 will not be aligned with the cam. The pin 34 and the piston rod 27 form a fixed right angle and therefore the pin 34 may not accommodate to different intermediate cam positions of the cam 36. This will then jam the pin inside the cam groove unless the latter has enough width for letting the pin be loose inside the groove but this again would allow a very poor engine performance because the force would not effectively be transmitted from the piston to the load.

U.S. Pat. No. 3,943,895 describes an axial cylinder internal combustion engine having a cylindrical cam is provided with special cam roller followers subjected to oil under pressure to keep them in close operating contact with the radial cam surfaces. Oil pressure is also used to maintain the pistons in contact with the circumferential cam surface. The engine further includes a rotary valve for supplying a stratified charge to each cylinder and unique means for continuously lubricating the valve face. The shape of the cam 30 in FIG. 1, as well as the rollers 40 and 50 and the way of driving these rollers by means of oil pressure teaches away from what is described in the present invention.

U.S. Pat. No. 4,366,784 shows a lightweight crankless piston engine utilizing cam action to produce two piston strokes for one revolution of the engine output shaft, which shaft does not pierce the piston or the combustion chamber. One section of the cam is embodied in the cylinder liner and the opposing cam section is an extension of the output shaft housing. In one embodiment, the engine is ported for fuel-air induction and exhaust. Cam induced piston rotation directly drives the output shaft while piston reciprocation is allowed without influencing such shaft. The cam 39 in FIG. 5 shows a sinusoidal track groove which is very different from the special contacting surface of the present invention. Another important difference is the particular way the mentioned patent shows how the mixture of air/fuel comes into the piston which may not be used for a two or four cycle Otto-type engine or a diesel one.

U.S. Pat. No. 4,565,165 reveals a hyper-expansion internal combustion engine operable using a cycle having expansion, exhaust, intake and compression phases comprising at least one pair of opposed pistons which reciprocate in cylinder portions which are in fluid communication with each other via a common combustion chamber, the pistons being coupled to respective cam elements engaged with a common output shaft for converting the reciprocating motion of the pistons into rotational motion, the cylinder portions having intake and exhaust ports in the cylinder walls arranged such that each intake port is engaged by one piston and each exhaust port is engaged by the respective opposed piston; and the cam elements are provided with different cam profiles which are arranged to cause the respective pistons to uncover the respective exhaust and inlet ports so as to produce a sufficient increase in the effective volume of the expansion phase with respect to the intake phase to give hyper-expansion. This document is directed to obtain hyper-expansion of combustion gases and therefore needs at least two opposing pistons (FIGS. 3 and 4). On the other hand, in FIG. 8 different types of cams are shown (212, 214, 216 and 218), all of which are different from the the one shown in the present invention. Here again the engagement of the cam with the ball bearing rollers may be jammed because the latter form a fixed angle with the former, when the cam is rotating.

U.S. Pat. No. 5,749,337 describes a barrel type engine with two-stroke cycle of operation. The engine of the mentioned document comprises two engine halves, each half having a plurality of pumping cylinders and a matching number of power cylinders. Double-ended pistons impart rotational motion to the engine shaft by a cam. In operation, intake air is drawn into the pumping cylinders and then transferred to the power cylinders by a transfer duct system. According to the document, due to the timing characteristics inherent in the engine of the mentioned document, intake air is forcibly transferred to the power cylinders, ensuring favorable cylinder scavenging and filling for high efficiency. The diameter of the pumping cylinders is larger than that of the power cylinders, resulting in a net supercharging effect and further enhancing power output. FIGS. 1 and 2 show the axis 10 which rotates together with the cam 20 due to the impulse of the double-effect pistons 30. however the figures fail to clearly show the engagement of cam 20 with the pistons 30. Since the cam has a concave and a convex portion, it seems its rotation is only possible if there is a single engagement line with a wide contacting constraining track. If this is so, the engine will show very poor performance, very noisy functioning and quick mechanical wear-out. In this engine the pistons 200 shown in FIG. 2 pump the air/fuel mixture and the pistons 210 generate mechanical power, which is totally different from the present invention.

U.S. Pat. No. 5,890,462 describes a tangential driven rotary engine (10) comprising an engine block (12) having a plurality of cylinder combustion chambers (14) radially positioned therein. A plurality of pistons (16) are each movable and disposed within each cylinder combustion chamber (14) in the engine block (12). A plurality of spark plugs (18) are each radially positioned on the engine block (12) to extend into one cylinder combustion chamber (14). A plurality of intake valves (20) are each radially positioned on the engine block (12) to extend into one cylinder combustion chamber (14). A plurality of exhaust valves (22) are each radially positioned on the engine block (12) to extend into one cylinder combustion chamber (14). A main motor shaft (24) extends centrally through the engine block (12) with the cylinder combustion chambers (14) and the pistons (16) radially positioned thereabout. A facility (26) is for changing the reciprocating motion of the pistons (16) into a rotary motion for the main motor shaft (24). A component 28 on the main motor shaft (24) is for operating each of the spark plugs (18), each of the intake valves (20) and each of the exhaust valves (22) in timed intervals. FIG. 4 shows the cam 52 with curved and engraved tracks, and particularly with concave and convex curves. This is different from what is described in the present invention which includes parallel or congruent contours and therefore may be constructed in a much easier way and with simple tooling. A further difference among both inventions is shown in FIG. 2 of the mentioned patent where the link of the piston 44, by means of the rod 46, and the roller 54 may not guarantee that the piston will stop from rotating around its longitudinal axis and therefore the piston may eventually get lose from the axle is 24. Finally, FIG. 2 seems to show that roller 54 is connected to the cam 52 forming a right angle with the periphery. This would cause the roller to slide but not to roll around its rotational axis.

U.S. Pat. No. 5,992,357 describes a piston driven axial cylinder engine composed of a flange (1) with its cylinders (10) in a circular disposition, the support (16) of the motor main shaft (2), and the carrier (20) supporting the central pivot (7). Around this central pivot (7), the disc (6) has a mutating motion. The extremity (4) of the shaft describing a circle drives the shaft (2) in rotation. The disc (6) pivots the extremity of the connecting rods (8). The distribution disc (17) with the lobes (18), placed coaxially in the motor main shaft (2) whence it takes its rotation, actuates the valves (12) and (13) placed in the cylinder heads (11). The auxiliary (21), which too takes its rotations from the motor main shaft (2), serves to set in motion the auxiliary equipments. When the pistons are set in motion, as in the case of internal combustion motors, their alternative straight-line motion is transformed in rotative motion of the motor main shaft (2). The overall functioning principle is different from the one described in the present invention because it does not base its movement on an alternate piston movement which is changed into rotational one by means of a specially designed surface track.

OBJECTS OF THE INVENTION

An object of the invention described herein is an internal combustion engine with all the advantages mentioned in the preceding paragraph and which has a novel mechanism for connecting the pistons to the drive shaft.

Another object of the present invention is a connecting mechanism between the pistons and the drive shaft which avoids the use of crankshafts, connecting rods and main bearings

SUMMARY OF THE INVENTION

The present invention consists of an internal combustion engine including pistons which transmit their power by means of the contact of their rods on the polished surface of a connecting piece in the form of a guiding track mounted on its drive shaft, in which the geometrical axis of the shaft intersects the principal plane of the connecting piece forming a certain angle, thus avoiding the need for a crankshaft and obtaining greatly improved mechanical power output, as well as lower manufacturing costs compared to prior art engines.

BRIEF DESCRIPTION OF THE ENCLOSED FIGURES.

FIGS. 15 to 20 are simplified perspective drawings of different embodiments of the arrangement of the connecting pieces ("revolving tracks") in accordance with the present invention.

FIG. 21 is a simplified drawing of a preferred embodiment of the arrangement for a multi-cylinder engine, in accordance with the present invention.

DETAILED DESCRIPTION OF THE INVENTION

Figure 1:
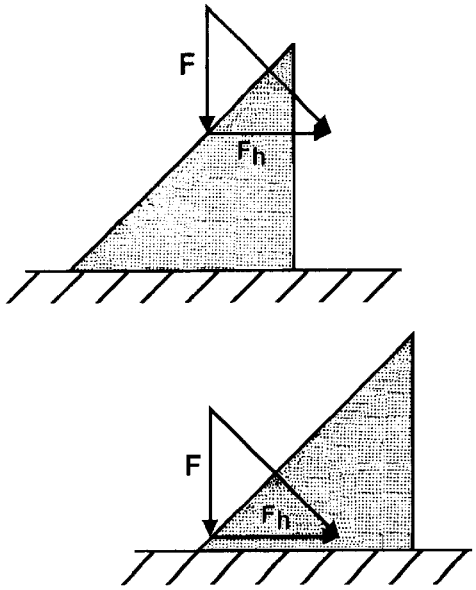
FIG. 1 is a side view of a wedge which slides over a plane surface due to the effect of a force applied to its slanted face.

The invention is based on the effect produced by a wedge when a force F acts on an inclined plane forming a certain angle to it (FIG. 1). The horizontal component Fh of the force F causes the "wedge" (which rests on a plane surface) to slide in the same direction as the component Fh. This movement will really take place provided that the sliding force (F multiplied by the sliding coefficient between the wedge and the plane surface) is smaller than the component Fh, i.e. when the condition of movement of the main shaft is:

$$F \times \text{sliding coefficient} < Fh.$$

In the motor mechanism of the invention, the force Fh causes the main shaft of the motor to turn.

The force F is generated in each of the engine's pistons and is equal to:

$$F = p \times 3.14 \times d \times d/4$$

where p is the mean internal pressure of a piston, being d its diameter.

Figure 2:
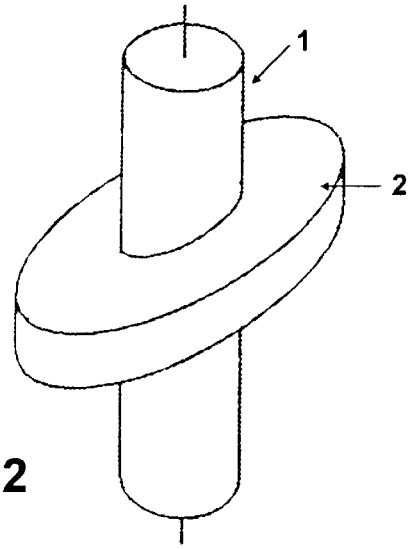
FIG. 2 is a simplified side perspective view of the main shaft of the engine with one of the connecting elements between the piston and shaft shown according to the present invention.

Based on this simple effect, in FIG. 2. it can be seen that, unlike conventional crankshafts which are angled, the proposed engine is mainly formed by a main shaft 1 which is in a straight line. On this straight shaft, there is a "revolving track" 2 at a certain angle to it, upon which the pistons transform their alternating straight line movement into a circular shaft movement.

Figure 3:
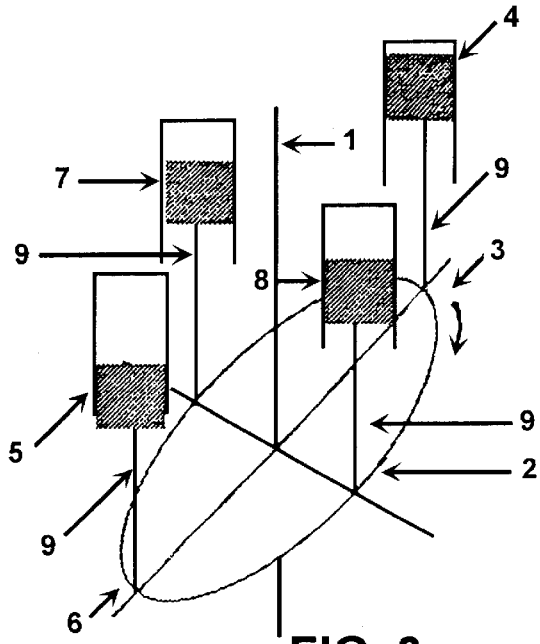
FIG. 3 is a schematic view of the relative position of the pistons in a four stroke four piston engine in accordance with the present invention.

In FIG. 3, point 3 is the position in which the piston 4 is at top dead center, whilst piston 5 is at bottom dead center 6. When this occurs, pistons 7 and 8 are at the mid-point of their respective upward or downward strokes whilst the shaft turns clockwise. Therefore, in FIG. 3 the relative positions of a four-stroke engine with four cylinders are schematically shown. It may be seen that the sequence is such that, while two pistons, e.g. 4 and 7 are in their expansion stroke, the other two pistons 5 and 8 are in their exhaust stroke.

While the pistons move in their expansion cycle in a straight line, they transmit their power through the rods 9 and the "revolving track" 2, which, being firmly attached to shaft 2, urges it to turn one way only.

After a ½ turn of the drive shaft the expansion cycle of one piston is completed and the cycles of exhaust, intake and compression start.

Since there is a 90° angle difference between each piston, the 4-stroke cycle of the following piston starts after the engine has made a ¼ turn.

Summarizing, in the internal combustion engine of FIG. 3 of the present invention, the novelty is based on the fact that it consists of one straight main drive shaft 1, which revolves when driven by the alternate movement of the pistons 4, 5, 7 and 8, which transmit their power through the contact of the rods 9 and an engaging part, the "revolving track", the principal plane of which is inclined at a certain angle with respect to the geometric axis of the shaft of motor 1.

Figure 4:
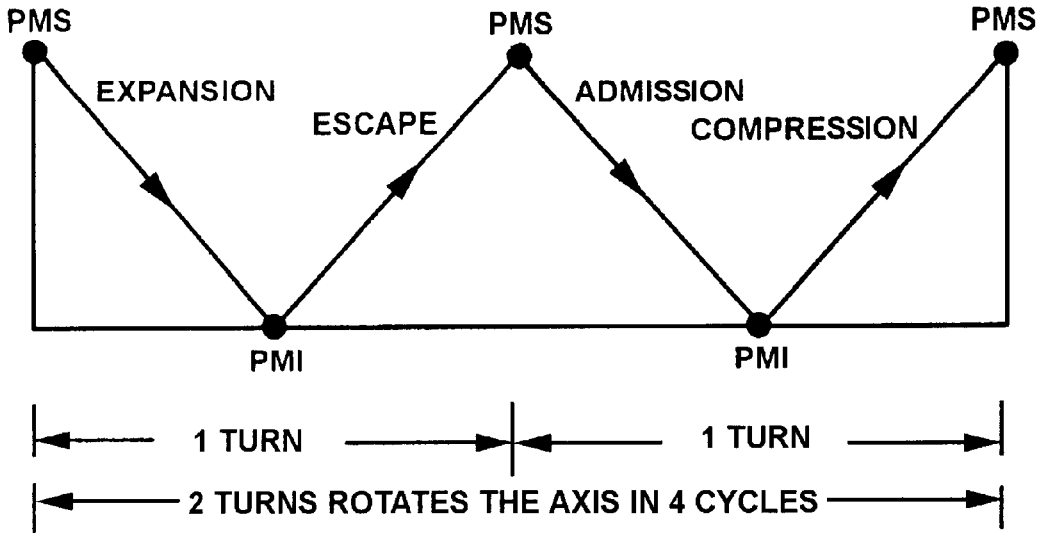
FIG. 4 is a graph showing the sequence of the four strokes of a piston in an engine in accordance with the present invention.

In the graph shown in FIG. 4 it can be seen that, when a piston has completed its full cycle of intake—compression—expansion—exhaust, the drive shaft has made two complete turns. In this figure the letters PMS stand for top dead center and PMI stand for bottom dead center.

Figure 5:
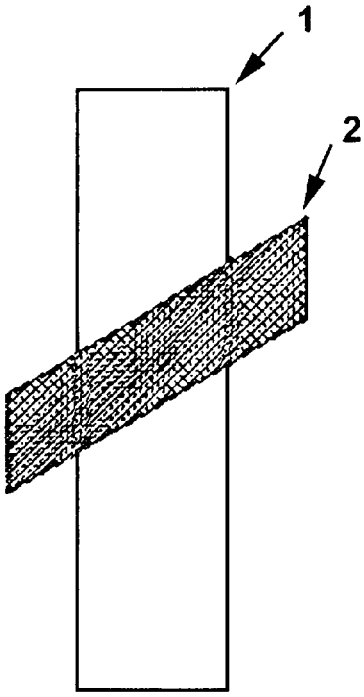
FIG. 5 is a schematic lateral view of a main shaft with a straight connecting piece for one or more pistons.

In FIG. 5 a first embodiment can be seen in which the "revolving track" 2 is flat and forms a certain angle with the drive shaft 1, which will preferably be within a range of 15° to 85° with respect to the geometric axis of the drive shaft 1.

In a preferred embodiment, the simple and easy construction of this "track" is based on a hollow cylinder with an interior diameter equal or less than the one of the drive shaft. Two parallel cuts forming an angle with the central shaft of the cylinder are made in this hollow cylinder. The resulting solidly united connecting piece 2 (the "revolving track") is then fixed to the main drive shaft 1 by any known fixing process such as arc welding or alike.

With this arrangement for the mentioned track, with each turn of the shaft a piston will have moved from its upper dead center to its lower dead center, i.e. it will have made one complete stroke.

Figure 6:
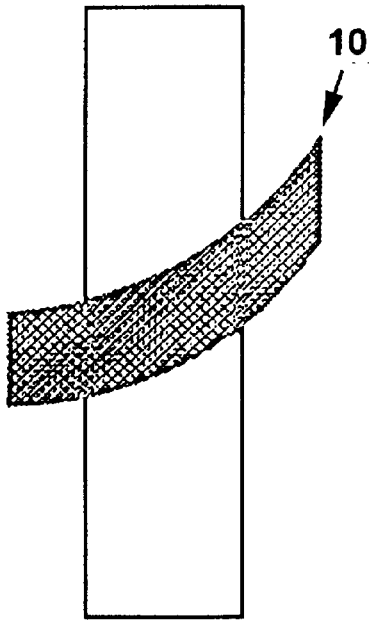
FIG. 6 is a schematic lateral view of a main shaft with a curved connecting piece to one or more pistons, in accordance with the present invention.

In FIG. 6 another preferred embodiment is shown. Since the stroke of the version with a straight "track" takes a certain time, a time reduction is attempted by means of a track that instead of being straight has the curvature of a cycloid 10.

Figure 7:
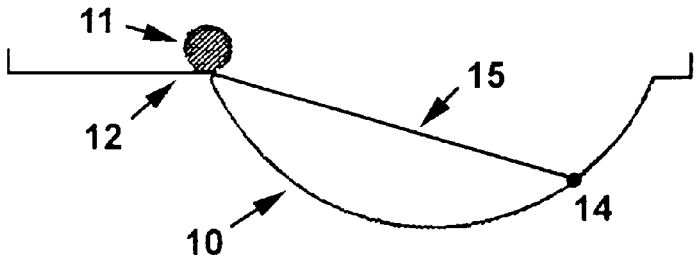
FIG. 7 is a representation of a cycloid curve compared with a straight-line inclined plane, in accordance with the present invention.

It has been mathematically proved that the cycloid curve optimizes this application, being a brachistochrone. In the mathematical definition of the different possible curves, a cycloid is defined as a brachistocrone according to the following criteria: if two spheres 11 are allowed to drop at the same time from point 12 (FIG. 7) the sphere which runs along the cycloid curve 10 will reach point 14 before the sphere which runs along the straight line 15. The property of being a brachistrochrone means that the cycloid is the fastest curve path and the function which determines its profile is obtained by a mathematical analysis calculation or from practical experience and which will not be demonstrated here as being beyond the scope of the present patent application. More details referred to these particular curves may be found in the Encyclopedia Britannica under the chapter of "The isoperimetric problem", which may be consulted through the Internet at the corresponding licensed website www.britannica.com.

The special feature of this type of curve is that the piston would move quicker if the "revolving track" were to have the shape of a cycloid curve 10. In this way the shaft would revolve quicker, resulting in higher engine power and performance.

Figure 8A:
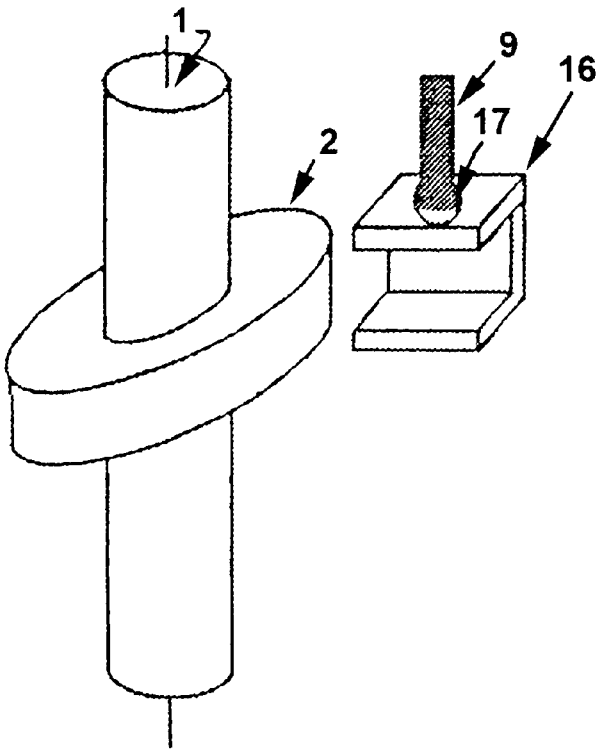
FIGS. 8A and 8B are simplified side perspective views of two preferred embodiments the main drive shaft equipped with the corresponding connecting piece to one or more pistons in accordance with the present invention.
Figure 8B:
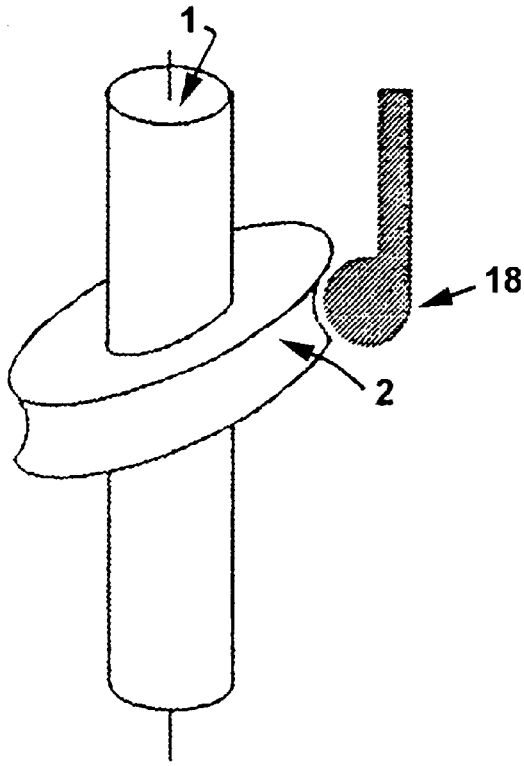

In any case, whichever the geometric form of the revolving track may be, the mechanism 16 connecting the piston connecting rod 9 with the revolving track 2 should be such so as to allow the free alternative straight-line sliding of the connecting rod 9 and the rotary movement of the shaft 1, as well as an adequate contact with the "revolving track" 2. For this purpose the mechanism must have a cardan-joint-like movement 17, or alternatively a hinge-joint 18 or other similar mechanism. For an engine with the pistons placed all on one side, the shapes would be of the type indicated in FIGS. 8A and 8B.

Figure 9:
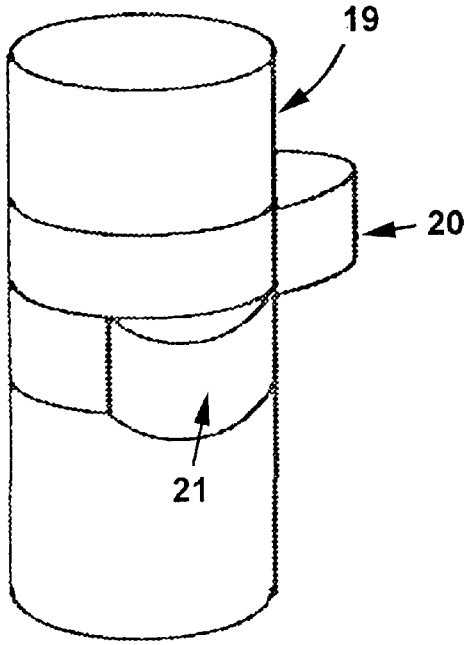
FIG. 9 is a simplified side view of a version of a camshaft for a four cylinder engine in accordance with the present invention.
Figure 10:
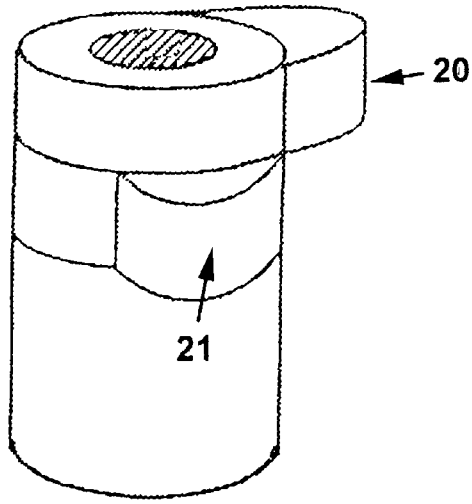
FIG. 10 is a simplified perspective view of a cam shaft which makes it possible to vary the angle of opening and closing of the inlet and exhaust gas valves in accordance with the present invention.

In the preferred embodiments the fact that the pistons are placed around a circumference has the advantage that the camshaft 19 driving the inlet and exhaust valves of all the cylinders can also have a simplified circular shape FIG. 9 illustrates a possible shape for a camshaft 19 for a four cylinder engine. There, it can be observed that the cams 20 and 21, which in the drawing are shown at 90° out of phase to each other, may also be mounted sharing one central shaft so as to allow whatever type of valve crossing is desired. In FIG. 10 it can be seen that this is easily achieved by simply turning the cam 20 with respect to the other cam 21, allowing a variable regulation of the inlet and exhaust valves.

In this way, a single cam shaft with two cams could drive the inlet and exhaust valves of all the cylinders at the required moment. Moreover, it would not be necessary to have a cam for each valve, with a consequent saving in material proportional to the number of cylinders, as well as the energy-saving resulting from the movement of the simplified cam shaft.

Of course, this implies that the inlet and exhaust valves would also be arranged in a circular fashion even though both would be driven from different planes.

Figure 11:
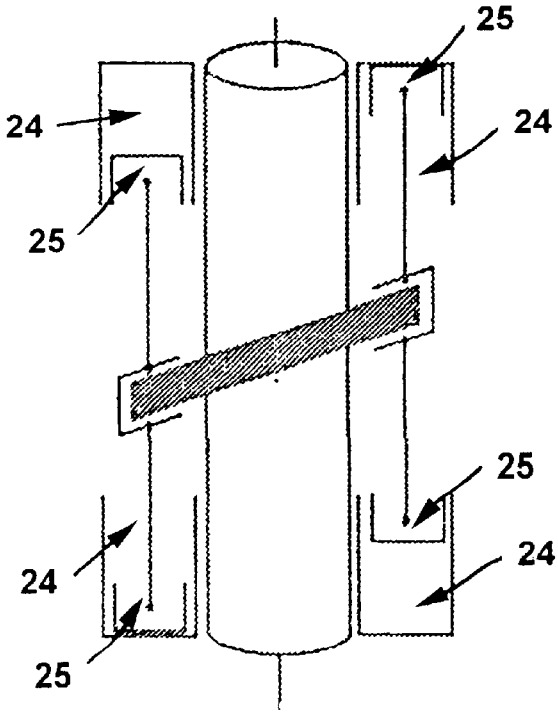
FIG. 11 is a simplified drawing of the arrangement of opposed pistons in a preferred version of a multi-cylinder engine, in accordance with the present invention

The important feature of placing the cylinders in a circle round the central shaft would make possible to use a larger number of cylinders 24, as is shown in FIG. 11. There, an engine with sixteen pistons 25 facing each other in pairs is shown; the inlet and exhaust valves of which are operated by a camshaft for each group of eight cylinders.

Figure 12:
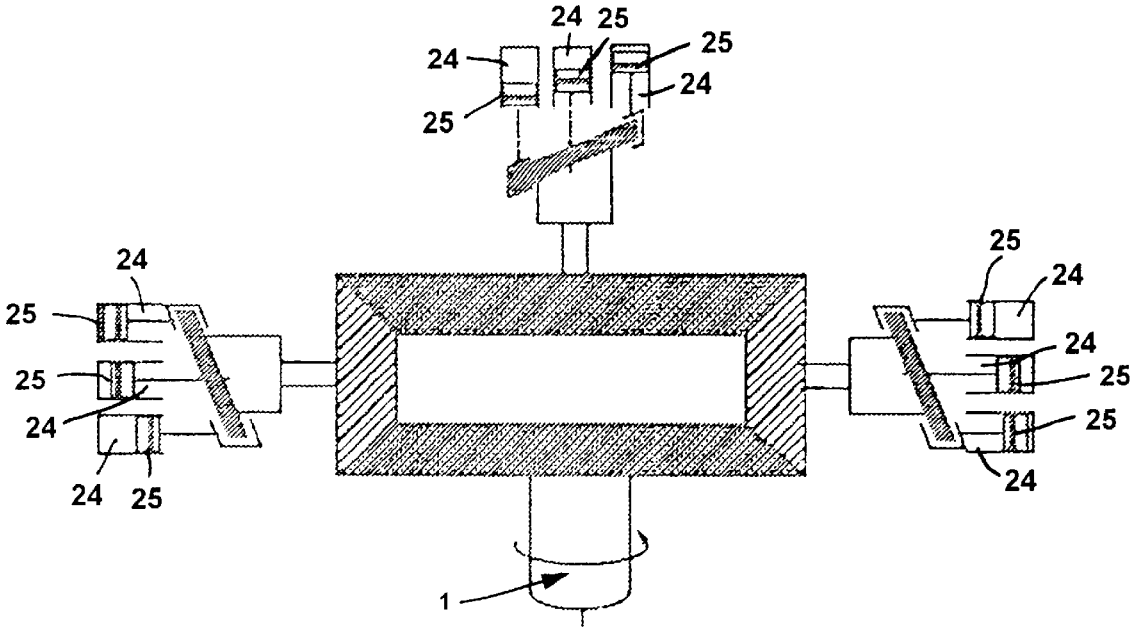
FIGS. 12, 13 and 14 are simplified perspective drawings of the arrangement of the connections of the cylinders with the drive shaft in different preferred versions of multi-cylinder engines in accordance with the present invention.

Another example of a multi-cylinder engine is shown in FIG. 12. This engine may have up to thirty two cylinders 24, with pistons 25 which all finally deliver power to a single drive shaft 1.

Figure 13:
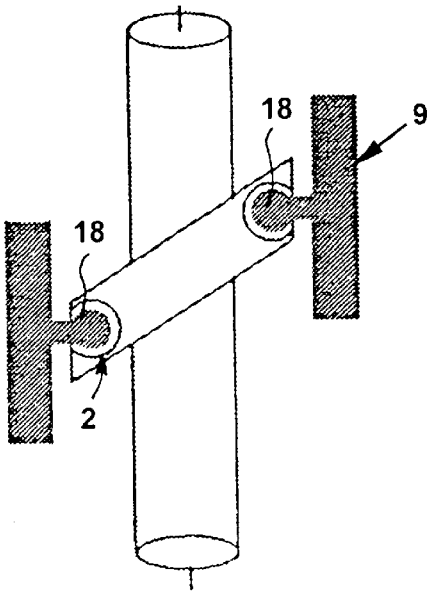

Another example of a configuration with opposed cylinders, in accordance with the present invention, is shown in FIG. 13.

Figure 14:
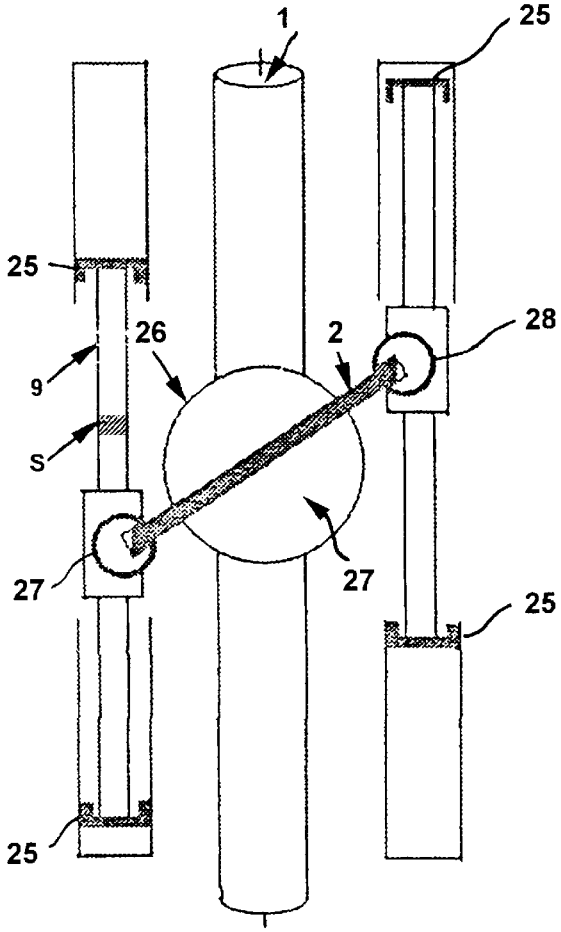

The outline drawing in FIG. 14 shows a multi-cylinder engine with opposed pistons 25, although it could also be built with pistons placed on one side only. Here, on the main drive shaft, a sphere 26 mounted concentrically to the drive shaft may be seen. This sphere has the "revolving track" 2 firmly attached, so that the pistons transmit the power to rotate the main drive shaft. Placing the sphere in this position makes it possible to have a higher number of pistons 25 around it, and also serves as a flywheel for the engine. This highly preferred embodiment of the invention has the special feature of allowing a simple design for the ball and socket joint which connects the rod with the "revolving track", leading to a reduction in cost and higher engine output.

Additionally, if this sphere 26 is made hollow, it can serve as a container for lubricating oil 27 for lubricating the parts in contact with the "revolving track" 2 and for lubricating the hinge joint 28 which transmits power to and from the pistons 25.

The lubricating oil can enter the sphere by any of the known methods and once there, through centrifugal force, it will be impelled towards the contact area of the rotating hinge-joint and also towards other points of difficult access for lubrication.

OTHER EMBODIMENTS OF THE INVENTION

The main drive shaft 1 can have other embodiments of "revolving tracks" 2 as shown in FIGS. 15 to 20.

FIG. 21 shows another embodiment of main drive shaft, the construction of which is particularly simple and easy to build.

Figure 22:
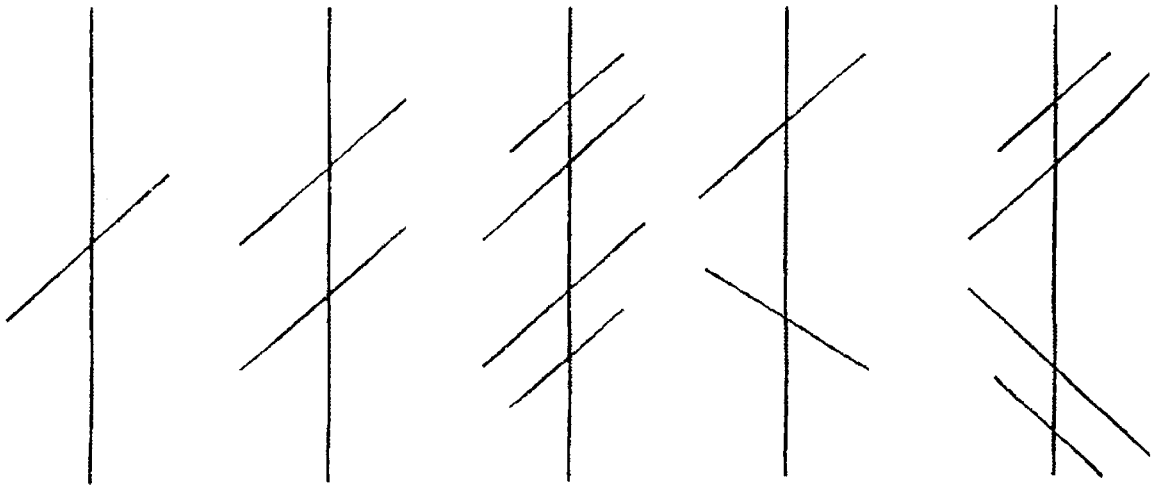
FIG. 22 is a simplified drawing of different positions which can be adopted by the connecting pieces ("revolving tracks").

FIG. 22 is a simplified drawing of different positions which can be adopted by the connecting parts ("revolving tracks") and also the practically unlimited number of "revolving tracks" which can be installed on one shaft.

Figure 23:
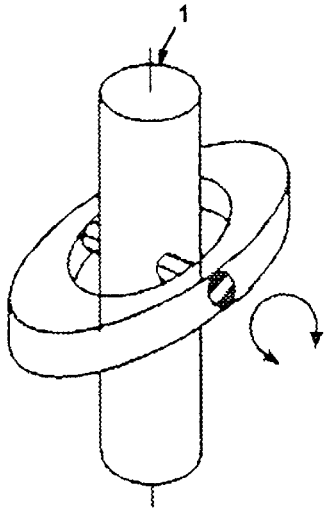
FIG. 23 is a simplified side perspective view of a preferred version which allows the piston stroke to be varied by altering the angle of the connecting piece ("revolving track").

FIG. 23 is a simplified side perspective view of a preferred embodiment which allows the "revolving track" 2, whatever its shape may be, to vary its inclination angle with respect to the main drive shaft and in this way modify the compression ratio of the engine.

Figure 24A:
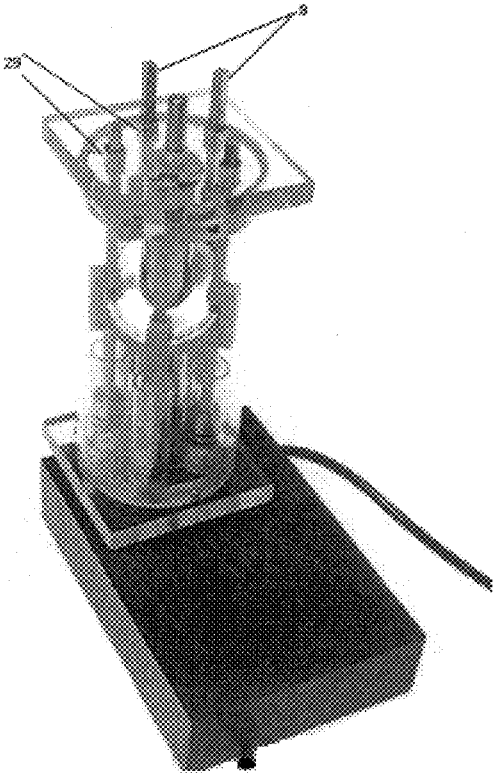
FIGS. 24A and 24B are side perspective views in photographs of another demo prototype of the invention.
Figure 24B:
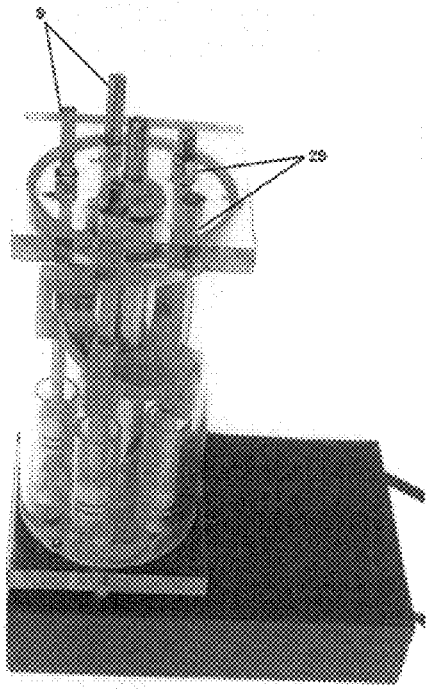

The photographs of FIGS. 24A and 24B show other perspective views of another didactic model of the engine. The figures show a better view of particular features of the piston rods 9 and a set of supports 29 which are of great importance for the invention. In order to avoid a rotation of each of the piston rods 9 around their own longitudinal axis, they may adopt different transverse sections S (see also FIG. 14) other than circular, i.e. they may be manufactured with sections such as: elliptic, ovoid, triangular, rectangular, square, etc. or any other shape that may avoid rotation. The piston rods 9 run through the fixed supports 29 and these have the same general shape as the piston rods. These fixed supports avoid the rotation of the piston rods and also avoid miss-alignment of the piston rods, since they absorb the lateral force component which is appears when the axial piston force is decomposed at the engaging revolving track.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than restrictive sense.

What is claimed:

1. An internal combustion engine with a drive shaft actuated by sliding motion, having pistons and a straight main drive shaft which rotates when driven by the alternate movement of said pistons, wherein said pistons transmit their power through the contact of their rods on the polished surface of a connecting member in the form of a guide track which is mounted on said engine, in which the geometric axis of said drive shaft intersects the principal plane of said connecting member forming an angle which is not equal to 90°, the engine further comprising a mechanism which connects the stem of each of the pistons to said connecting member has a cardan (universal) joint.

2. The internal combustion engine according to claim 1, wherein the contact surface of said connecting member is flat.

3. The internal combustion engine according to claim 1, wherein said mechanism is a ball and socket joint.

4. The internal combustion engine according to claim 1, wherein the pistons are arranged around a circumference centered on the geometrical axis of the drive shaft and that the inlet and exhaust valves are arranged around a different circumference, also centered on the geometrical axis of the drive shaft.

5. The internal combustion engine according to claim 1, wherein the said angle formed by the intersection of the geometric axis of said engine with the principal plane of the connecting piece is within a range of 15° to 85°.

6. An internal combustion engine with a drive shaft actuated by sliding motion, having pistons and a straight main drive shaft which rotates when driven by the alternate movement of said pistons, wherein said pistons transmit their power through the contact of their rods on the polished surface of a connecting member in the form of a guide track which is mounted on said engine, in which the geometric axis of said drive shaft intersects the principal plane of said connecting member forming an angle which is not equal to 90°, the engine further comprising a camshaft that has cams out of phase at angles of 360°/N, where N is the number of cylinders in the engine.

7. The internal combustion engine according to claim 6, wherein said cams are mounted sharing a central shaft, and may be regulated in their crossing with the inlet and exhaust valves by means of a relative turn in each shaft individually.

8. An internal combustion engine with a drive shaft actuated by sliding motion, having pistons and a straight main drive shaft which rotates when driven by the alternate movement of said pistons, wherein said pistons transmit their power through the contact of their rods on the polished surface of a connecting member in the form of a guide track which is mounted on said engine, in which the geometric axis of said drive shaft intersects the principal plane of said connecting member forming an angle which is not equal to 90°, the engine further comprising a mechanism which connects the stem of each of the pistons to said connecting member has a cardan (universal) joint; and comprising a cam shaft that has cams out of phase at angles of 360°/N, where N is the number of cylinders in the engine.

9. An internal combustion engine with a drive shaft actuated by sliding motion, having pistons and a straight main drive shaft which rotates when driven by the alternate movement of said pistons, wherein said pistons transmit their power through the contact of their rods on the polished surface of a connecting member in the form of a guide track which is mounted on said engine, in which the geometric axis of said drive shaft intersects the principal plane of said connecting member forming an angle which is not equal to 90°, the engine further comprising a mechanism which connects the stem of each of the pistons to said connecting member has a cardan (universal) joint; and comprising a cam shaft that has cams which are mounted sharing a central shaft, and wherein said cams may be regulated in their crossing with the inlet and exhaust valves by means of a relative turn in each shaft individually.

10. An internal combustion engine with a drive shaft actuated by sliding motion, having pistons and a straight main drive shaft which rotates when driven by the alternate movement of said pistons, wherein said pistons transmit their power through the contact of their rods on the polished surface of a connecting member in the form of a guide track which is mounted on said engine, in which the geometric axis of said drive shaft intersects the principal plane of said connecting member forming an angle which is not equal to 90°, the engine further comprising a mechanism which connects the stem of each of the pistons to said connecting member has a cardan (universal) joint; and wherein said angle is variable for modifying the compression ratio of the engine.

* * * * *